United States Patent [19]

Sodec

[11] 4,291,615

[45] Sep. 29, 1981

[54] LINEAR AIR OUTLET

[75] Inventor: Frank Sodec, Wuerselen-Broichweiden, Fed. Rep. of Germany

[73] Assignee: Firma H. Krantz GmbH & Co., Aachen, Fed. Rep. of Germany

[21] Appl. No.: 79,540

[22] Filed: Sep. 27, 1979

[30] Foreign Application Priority Data

Sep. 29, 1978 [DE] Fed. Rep. of Germany ... 7828982[U]

[51] Int. Cl.[3] ..... F24F 13/06

[52] U.S. Cl. ..... 98/40 C; 98/40 D; 98/41 AV

[58] Field of Search ..... 98/40 R, 40 C, 40 D, 98/40 V, 40 N, 41

[56] References Cited

U.S. PATENT DOCUMENTS

| | | | |
|---|---|---|---|
| 2,372,830 | 4/1945 | Honerkamp et al. | 98/41 AV X |
| 3,194,145 | 7/1965 | Robertson, Jr. | 98/41 R |
| 3,250,205 | 5/1966 | Lambert | 98/40 D |

FOREIGN PATENT DOCUMENTS

| | | | |
|---|---|---|---|
| 2529825 | 1/1977 | Fed. Rep. of Germany | 98/40 D |
| 2306606 | 10/1976 | France | 98/40 D |

*Primary Examiner*—Edward G. Favors
*Assistant Examiner*—Harold Joyce
*Attorney, Agent, or Firm*—W. G. Fasse; D. F. Gould

[57] ABSTRACT

The present linear air outlet comprises a tubular member provided with an air outlet channel formed by two side walls arranged in parallel to each other and reaching into the tubular member. One side wall is perforated. A closure member is movable up and down, for example manually, in the air outlet channel. The closure member has slanted wall surfaces facing alternately into opposite directions inside the air outlet channel so that the slanting surfaces face the respective perforated side wall. Thus, the closure member performs two functions. It opens or closes the perforations in the side walls and with its slanted surfaces it directs the air in a desired direction.

7 Claims, 5 Drawing Figures

LINEAR AIR OUTLET

BACKGROUND OF THE INVENTION

The invention relates to a linear air outlet including outlet elements arranged in or on a distributing channel in series along its length, from which air may be blown out in the form of oppositely directed jets.

The supply air jets in known air outlets of this type enter with a constant blow out angle into the space, whereby the blow out angle depends on the structural dimensions of the outlet elements, on the volume flow, and finally to a certain extent also on the temperature difference between the room air and the supply air. An individual adjustment of the blow out angles is possible in prior art air outlets only due to the fact that several components arranged in series, of the individual outlet elements are so constructed that the individual components are rotatable about the longitudinal axis of the air outlets within a determined angular range. Due to the number of the individual components such air outlets are rather expensive and trouble prone.

OBJECTS OF THE INVENTION

It is the objective of the invention to produce a linear air outlet by means of which it is possible to vary the blow out angle of the exiting supply air jets in a simple manner, whereby the air outlet is nevertheless characterized by a simple structure having a high functional reliability.

SUMMARY OF THE INVENTION

Starting from a linear air outlet as described at the beginning it is suggested according to the invention for the achieving of the stated objective, that each outlet element comprises two lateral walls arranged in parallel to each other, whereby respectively one side wall comprises perforations which interconnect the inside of the distribution channel with the intermediate space between the side walls and in that a closure member having a prism cross-section is arranged in said intermediate space, said closure member being displaceable perpendicularly to the longitudinal axis of the distribution channel, and wherein the perforated side walls may be covered by said closure member to a lesser extent than the oppositely arranged, nonperforated side wall of the outlet element.

Thus, the air outlet according to the invention is composed of elements comprising merely two side walls and a closure member adjustable therebetween. The jets are subjected to a deflection depending on the position of the closure member due to the onflow which alternates from outlet elements to outlet elements. The deflection is determined either solely by the closure member or it is determined by the closure member in combination with the nonperforated side wall.

A further embodiment of the invention provides that the defining surface of the closure member facing the intermediate space between the side walls of the outlet elements forms an obtuse angle with the nonperforated side wall of the outlet element.

The sloping of the defining surface according to the invention determines, in one of the end positions of the closure member, the maximal blow out angle of the supply air jets, whereas, in the other end position of the closure member the nonperforated side wall of the outlet element, against which the supply air flows, determines the blow out angle.

According to a further embodiment of the invention, the defining surface of the closure member against which supply air flows through the apertures in one of the side walls of the outlet elements, is formed to be plane or concave.

The plane shape of the defining surface results in a maximal blow out angle of the supply air jets, whereas a defining surface which is more or less curved in a concave manner, deflects the jets correspondingly.

A further embodiment of the invention provides that the side walls of the outlet element are arranged inside the distribution channel, whereby the air outlet may be completely housed in the distribution channel without any projections beyond the distribution channel. Thus, the distribution channel itself will be visible at best unless the distribution channel itself is integrated into interior design elements. It is imaginable that the distribution channel is incorporated in pieces of furniture which are connectable to supply air channels or the distribution channel may be used as a foot or stand for an illuminating body.

Finally, the invention provides according to a further embodiment that a screen or perforated sheet metal is arranged at an angle to the side walls, said screen or perforated sheet metal separating, over the longitudinal section of the distribution channel, the zone of the outlet elements from the remaining channel cross-section.

The division of the distribution channel by means of the screen or perforated sheet metal according to the invention enhances the uniform distribution of the volume flow supplied to the outlet elements.

BRIEF FIGURE DESCRIPTION

An example embodiment of an air outlet according to the invention is illustrated in the drawing and will be described in more detail in the following:

DETAILED DESCRIPTION OF PREFERRED EXAMPLE EMBODIMENTS AND OF THE BEST MODE OF THE INVENTION

Figure 1:
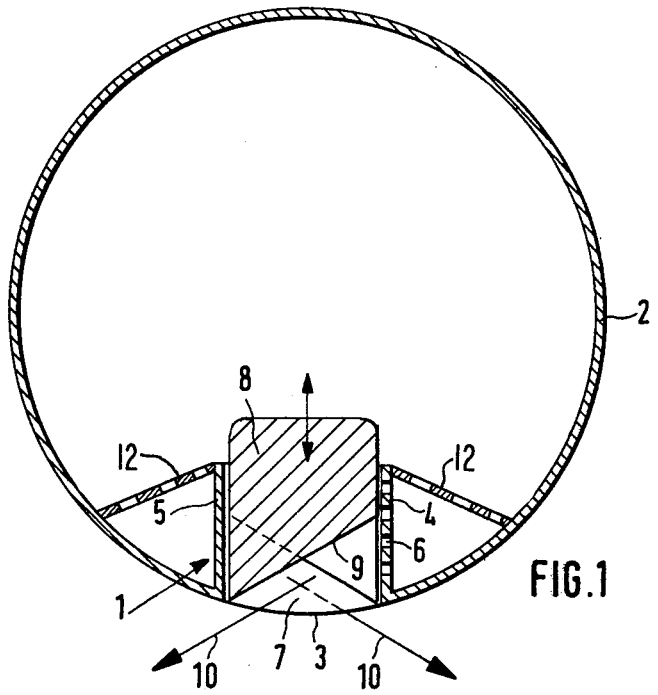
FIG. 1 shows an air outlet in section including outlet elements in which the closure members are located in an end position.
Figure 2:
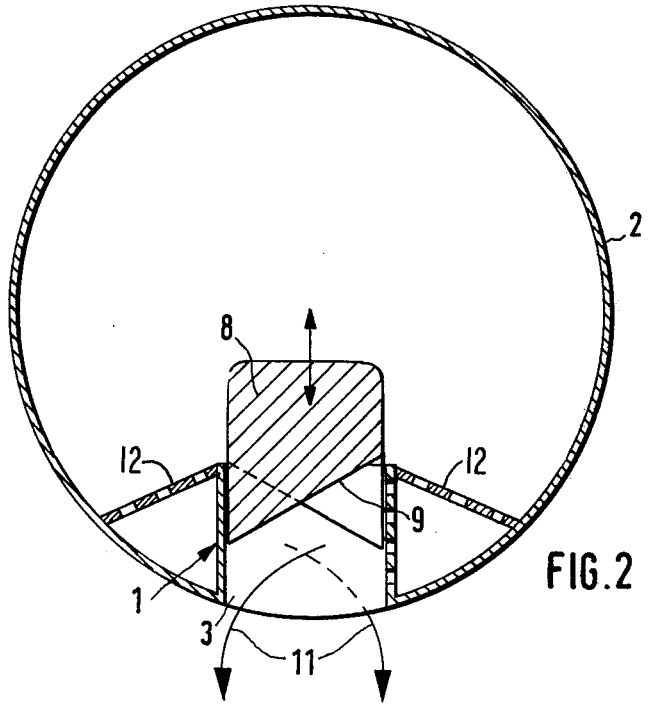
FIG. 2 shows an air outlet according to FIG. 1, however, showing the closure members in an intermediate position.

As shown in FIGS. 1 and 2 the outlet elements 1 arranged in series, are located within the cross-section of a circular air distribution channel 2 forming an air duct having outlet openings 3. Side walls 4 and 5 arranged in parallel to each other reach inside the distribution channel or air duct 2 on both sides of the outlet openings 3. The side walls 4 and 5 form a guide channel 7 for a closure member 8 as best seen in FIGS. 1 and 2. Each of the side walls 4 and 5 has completely closed sections and sections with perforations 6 arranged in alternating succession as indicated by the oppositely directed arrows in FIG. 3. Thus outlet element 1 comprises a sidewall section with perforations 6 whereas the opposite sidewall section is closed. In the next adjacent outlet element the side wall section 4' is perforated and the side wall section 5' is closed and so on.

Due to this construction the volume flow acts alternately on the intermediate space 7 between the side walls 4, 5 or 4', 5'.

A closure member 8 having a prism shaped cross-section is located in the intermediate space or channel 7 of each outlet element 1. The closure member 8 is displaceable perpendicularly to the longitudinal axis of the distribution channel. The closure member 8 has two parallel walls which are guided between the side walls 4, 5 in the channel 7. The closure member 8 is constructed to have such a shape that it covers the nonperforated section of the sidewalls 4, 5 over a larger area than the perforated side wall sections. The closure member 8 accomplishes the different coverings in that its deflecting wall 9 facing the intermediate space 7 forms an obtuse angle with one of the parallel walls of the closure member 8. The volume flow flowing through the perforations 6 out of the distribution channel 2 into the intermediate space 7 of an outlet element 1 is deflected depending on the position of the closure member 8. The deflection is in the direction of the arrows 10 according to FIG. 1 or in the direction of the arrows 11 according to FIG. 2 so that it is possible in the most simple manner to vary the blow out angle of the supply air jet by varying the position of the closure member 8.

Figure 3:
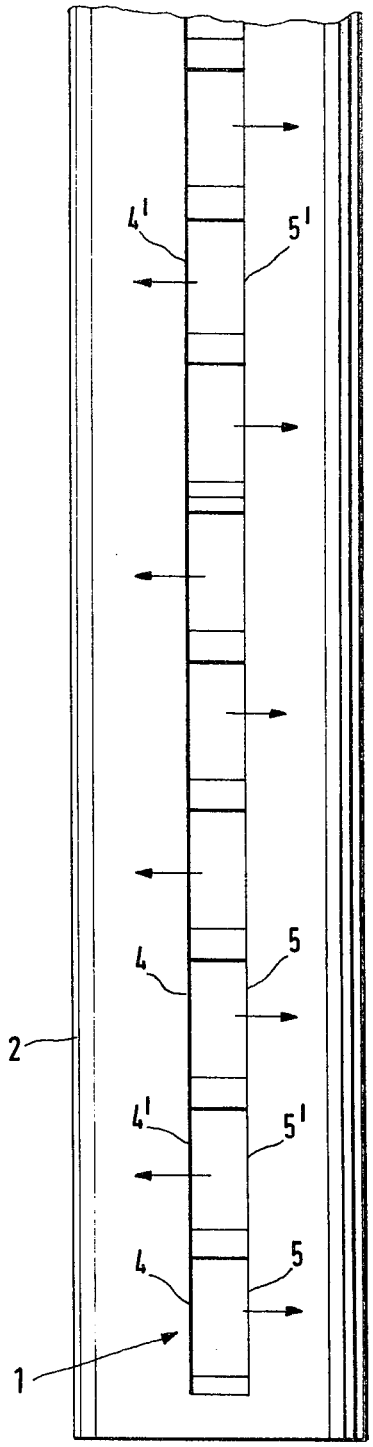
FIG. 3 is a top plan view of a broken off portion of an air outlet.

As illustrated especially in FIG. 3, a plurality of outlet elements 1 may be combined into a group and an air outlet may be assembled to comprise several groups of outlet elements of random length distributed over the length of a distribution channel.

A perforated sheet metal 12 separating the zone of the outlet elements 1 from the remaining channel cross section serves for uniformly distributing the volume flow over the length of the air outlet. The perforated sheet metal 12 is arranged at an angle relative to the side walls 4 and 5 and secured to the distribution channel 2.

Figure 4:
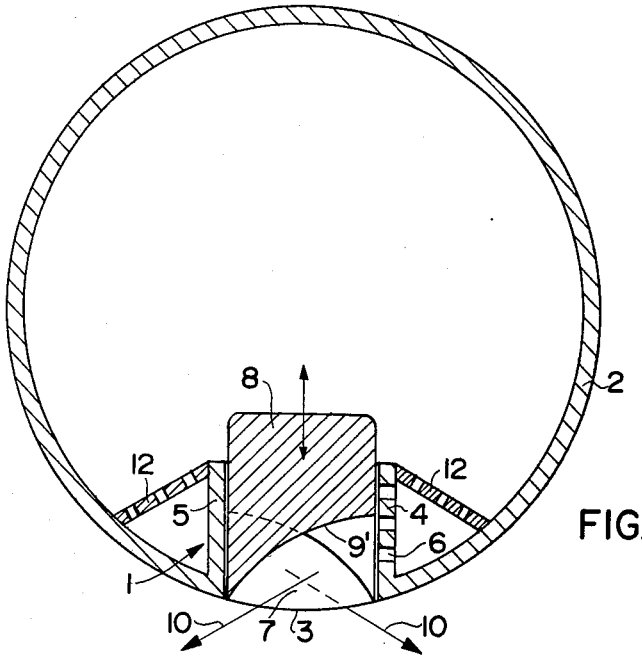
FIGS. 4 and 5 show an embodiment similar to that of FIGS. 1 and 2, however, with a closure member having a curved flow guide surface.
Figure 5:
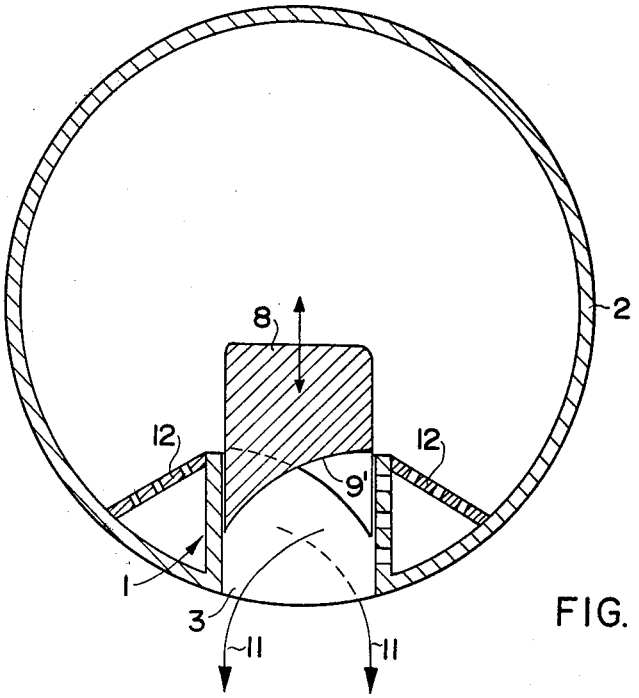

It will be understood that the air distribution channel 2 may have any desired geometric shape and that it may be used as a table outlet and as a wall outlet in or under the ceiling of a room. FIGS. 4 and 5 show an embodiment similar to FIGS. 1 and 2, however, with a concave flow guide surface 9' forming part of the closure member (8).

The adjustment of the closure members of the individual outlet elements may be accomplished manually, pneumatically, or it may be controlled or regulated by electrical means. Although the invertion has been described with reference to specific example embodiments, it will be appreciated, that it is intended to cover all modifications and equivalents within the scope of the appended claims.

I claim:

1. A linear air outlet device, comprising art duct means (2), two longitudinal wall members (4, 5) operatively arranged in parallel to each other to form an open guide channel, perforated sections (6) and non-perforated sections in each of said longitudinal wall members spaced along the length thereof in such a manner that non-perforated sections register with perforated sections, means operatively locating said parallel wall members relative to said duct means so that said perforated sections are exposed to air flowing in said duct means, whereby air may pass through said perforated sections into said open guide channel, a longitudinal channel closure member (8) having a prism cross-section slidably inserted in said open guide channel for displacement perpendicularly to the longitudinal axis of said open guide channel, said channel closure member (8) having air deflection surface means (9) slanting alternately in opposite directions so that the deflection surface means face a respective perforated section in said wall members, said channel closure member further having parallel surface means slidably fitting into said guide channel between said parallel wall members of said guide channel, said parallel surface means of said closure member performing a dual function by cooperating in the guiding of the sliding movement of said closure member inside said guide channel and by exposing a variable portion of said perforated sections to the passage of air therethrough, said slanting surface means guiding said air substantially in opposite directions out of said open guide channel.

2. The device of claim 1, wherein said air deflection surface means (9) of said channel closure member (8) encloses an obtuse angle with one of said parallel surface means of said channel closure member.

3. The device of claim 1 or 2, wherein said air deflection surface means comprise plane surfaces.

4. The device of claim 1, wherein said air deflection surface means comprise concave surfaces.

5. The device of claim 1, wherein said wall members of said open guide channel are located inside said air duct means.

6. The device of claim 5, further comprising perforated divider means (12) operatively and longitudinally held in position in said air duct means to separate said air duct means into two zones, one of which holds said guide channel.

7. The device of claim 6, wherein said perforated divider means (12) comprise two sections arranged at an angle relative to each other inside said air duct means.

* * * * *